US006009654A

United States Patent [19]

Williams et al.

[11] Patent Number: 6,009,654

[45] Date of Patent: Jan. 4, 2000

[54] TAMPER-RESISTANT SAFETY GUN LOCK

[75] Inventors: Robert A. Williams; Gary L. Embree, both of Garden City, Kans.

[73] Assignee: Inventure, Inc., Garden City, Kans.

[21] Appl. No.: 09/021,429

[22] Filed: Feb. 10, 1998

[51] Int. Cl.[7] ..... F41A 17/04

[52] U.S. Cl. ..... 42/70.11; 42/70.07; 206/317

[58] Field of Search ..... 42/70.07, 70.11, 42/70.08, 96; 70/DIG. 58; 206/317

[56] References Cited

U.S. PATENT DOCUMENTS

| | | | |
|---|---|---|---|
| 1,513,267 | 10/1924 | Parks | 42/70.11 |
| 2,519,662 | 8/1950 | Kempken | 206/16 |
| 2,877,689 | 3/1959 | Pribis | 206/317 |
| 2,924,330 | 2/1960 | Ballard . | |
| 3,018,576 | 1/1962 | Riechers . | |
| 3,307,755 | 3/1967 | Lentz | 206/317 |
| 3,419,728 | 12/1968 | Wilson . | |
| 3,802,612 | 4/1974 | Smith . | |
| 3,896,929 | 7/1975 | Mills | 206/387 |
| 4,043,754 | 8/1977 | Sklar | 248/220.4 |
| 4,119,199 | 10/1978 | Whitaker, Jr. | 206/317 |
| 4,155,608 | 5/1979 | Orlewicz | 248/201 |
| 4,299,045 | 11/1981 | Cervantes | 42/70.11 |
| 4,446,900 | 5/1984 | Markovich | 206/317 |
| 4,721,205 | 1/1988 | Burt et al. | 206/317 |
| 4,870,771 | 10/1989 | McClellan | 42/90 |
| 4,912,867 | 4/1990 | Dukes, Jr. | 42/70.11 |
| 4,916,842 | 4/1990 | Hardy | 42/70.07 |
| 4,934,083 | 6/1990 | Smith | 42/70.07 |
| 4,936,038 | 6/1990 | Johnson et al. | 42/106 |
| 5,012,605 | 5/1991 | Nishioka | 42/70.07 |
| 5,048,682 | 9/1991 | Taylor | 206/317 |
| 5,138,786 | 8/1992 | Fischer | 42/70.11 |
| 5,168,994 | 12/1992 | Beletsky et al. | 206/317 |
| 5,172,575 | 12/1992 | Fisher | 206/317 |
| 5,236,086 | 8/1993 | MacTaggart | 206/317 |
| 5,313,733 | 5/1994 | Meade | 42/70.11 |
| 5,419,068 | 5/1995 | Pages et al. | 42/70.07 |
| 5,437,119 | 8/1995 | Womack | 42/70.07 |
| 5,437,366 | 8/1995 | West et al. | 206/317 |
| 5,450,684 | 9/1995 | Harris | 42/70.07 |
| 5,458,266 | 10/1995 | Pichot | 206/317 |
| 5,621,996 | 4/1997 | Mowl, Jr. | 42/70.07 |
| 5,720,193 | 2/1998 | Dick | 42/70.11 |

FOREIGN PATENT DOCUMENTS

| | | | |
|---|---|---|---|
| 22346 | 6/1921 | France | 42/96 |

*Primary Examiner*—Stephen M. Johnson
*Attorney, Agent, or Firm*—Hovey, Williams, Timmons & Collins

[57] ABSTRACT

A tamper resistant safety gun lock (20) utilizes a case (22) having opposing sidewalls (24, 26) and at least one lateral wall (42, 48, 62) to inhibit access to crucial components of a firearm (28). A plurality of gun anchor posts (34) are selectively positionable inside of the case (22), so that the case (22) may be adapted for different types of firearms (28). The gun anchor posts (34) are held in a perforated plate (74) and have a flat disk (68) at one end which is held between the perforated (74) plate and one of the sidewalls. Because the flat disk (68) is held between the perforated plate (74) and one of the sidewalls the gun anchors (34) are generally inaccessible from the exterior of the case. The tamper resistant safety gun lock (20) is provided with a lock mechanism (32) which utilizes a catch (100) extending inwardly from a lateral lock wall. (48). The catch (100) is covered to make the case (22) difficult to pry open. Further, the lock mechanism utilizes a latch plate (92) having a width perpendicular to an opening direction (106) of the case (22) to provide additional strength against the case (22) being pried open.

28 Claims, 3 Drawing Sheets

TAMPER-RESISTANT SAFETY GUN LOCK

TECHNICAL FIELD

This invention relates to storage devices and, more particularly, to tamper resistant storage devices that inhibit access to crucial components of firearms.

BACKGROUND

Millions of people own rifles, shotguns, and pistols for recreational and security purposes. As evidenced by the ceaseless stream of accidents involving firearms, preventing children, teenagers, and other unauthorized people, such as intruders, from attaining access to these firearms is a problem that is yet unsolved. Intensifying this problem is the particular attraction which young children and teenagers appear to have for firearms. While an adult may think a firearm and its ammunition are safely put away, childhood resolve all too often finds a way to gain access to such weapons and inappropriately treat them as toys. The consequences of such play can be devastating, even life ending, to children, teenagers, and adults. Because of their vulnerability and innocence, it is indescribably saddening when a child or a teenager is killed or severely injured while playing with a firearm. Thus, any improvement in firearm safety which makes it even just a little harder for young children and teenagers to gain access to firearms is heralded as an important advance.

In previous efforts to address this problem, locking devices have been provided which clamp around the trigger guard of firearms for preventing access to the trigger. However, these devices do not and are not intended to inhibit access to the other crucial components of the firearm such as the hammer/firing pin and breech. Other devices can only be used with a limited number of gun configurations because the gun anchor is fixed in the device. Further, many such devices use externally accessible gun anchors, such as pins, to secure the firearm in the locking device. Externally accessible gun anchors present a point of attack for small children and teenagers to gain access to the firearm. Another typical point of attack is the lock mechanism of the device. Specifically, the lock mechanisms used heretofore are too easy to pry open.

SUMMARY OF THE INVENTION

Accordingly, one important object of the present invention is to provide an improved tamper resistant safety gun lock having a gun anchor that is selectively positionable to receive different firearms.

Another important object of the present invention is to provide an improved tamper resistant safety gun lock that inhibits access to substantially all of the crucial components of a firearm.

Still another important object of the present invention is to provide an improved tamper resistant safety gun lock having a gun anchor which is not generally externally accessible.

A further important object of the present invention is to provide an improved tamper resistant safety gun lock in combination with an improved lock mechanism which is more difficult to pry open.

In carrying out the foregoing and other objects, the present invention contemplates an improved tamper resistant safety gun lock having an outer case with opposing side walls. The case can be opened to gain access to a firearm and closed to inhibit access to the firearm. A lock mechanism is provided to lock the case in the closed position, so that only intended people may obtain access to the firearm held therein. A gun anchor is utilized to hold the firearm in the outer case when the outer case is locked in the closed position.

In a preferred embodiment, the outer case has a plurality of lateral walls extending from one sidewall to the other sidewall, and the sidewalls and lateral walls are arranged to inhibit access to the crucial components of the firearm including the trigger, hammer, and breech. A perforated plate is provided in an internal cavity of the case and has a plurality of gun anchor receptacles to receive the gun anchor and hold it in place. By providing many receptacles, the gun anchor is selectively positionable in the internal cavity of the outer case. The gun anchor preferably comprises a plurality of cylindrical posts having flat disks at one end. The flat disks are sized so that they will not pass through the gun anchor receptacles in the perforated plate and are preferably held between the perforated plate and one of the sidewalls. The ends of the posts opposite the flat disks are adjacent to and held inside the other sidewall. Thus, external access to the gun anchor is substantially inhibited.

The present invention further contemplates a lock mechanism in combination with a tamper resistant safety gun lock case. The lock mechanism has a rigid catch and a latch plate for engaging the catch whereby the case is locked in the closed position. The lock mechanism is also provided with structure for locking and structure for unlocking the case. To make the case more difficult to pry open, a cover is positioned over the catch. In a preferred embodiment, the locking and unlocking structures actuate a piston having an inner leg and an outer leg. The latch plate is held between the legs, so that the width of the latch plate is parallel to an opening direction of the case. The latch plate is further provided with an intermediate bend, so that the latch plate extends into increased engagement with the catch.

DETAILED DESCRIPTION

Figure 1:
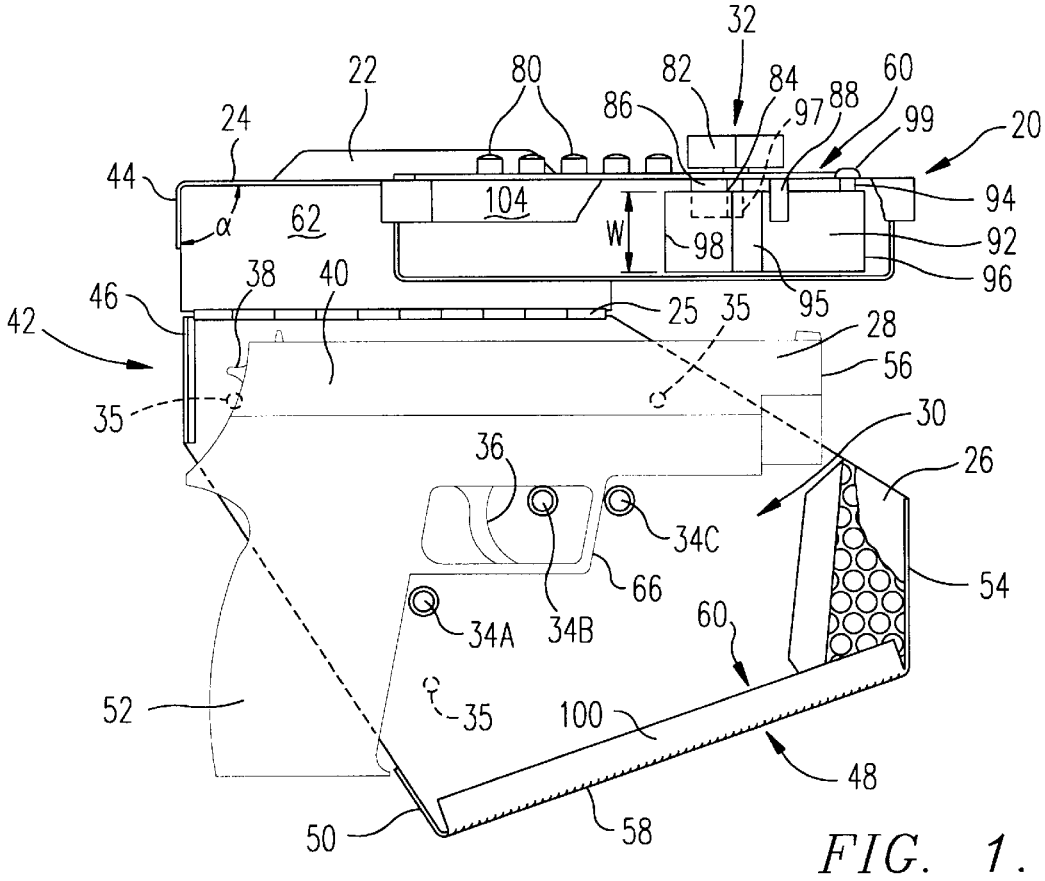
FIG. 1 is a front elevational view of a tamper-resistant safety gun lock according to the present invention and being shown in an open position.

Referring to the drawings in greater detail, FIGS. 1 and 7–10 show a tamper-resistant safety gun lock, generally designated 20, having an outer case 22. The outer case 22 is formed in part by opposing sidewalls 24, 26 connected by a hinge 25. The outer case has an open position, as shown in FIG. 1 allowing access to a firearm 28 which is held in an internal cavity, generally designated 30, of the case 22. Further, the outer case has a closed position, as shown in FIGS. 7–10, which inhibits access to the firearm 28. When the outer case is in the closed position, the case inhibits access to the crucial components of the firearm including the trigger 36, hammer/firing pin 38, and breech block 40. A lock mechanism, generally designated 32, is housed, at least in part, inside of the case 22 and is operably disposed between the first sidewall 24 and second sidewall 26 to lock the case in the closed position. A gun anchor, which preferably includes a plurality of posts 34, extends through the internal cavity 30 to hold the firearm in place relative to the opposed sidewalls. Hereinafter, the hammer/firing pin will be referred to only as the hammer, and the term hammer should be construed so as to include one or both of the hammer and the firing pin as may be appropriate for a specific firearm.

Figure 2:
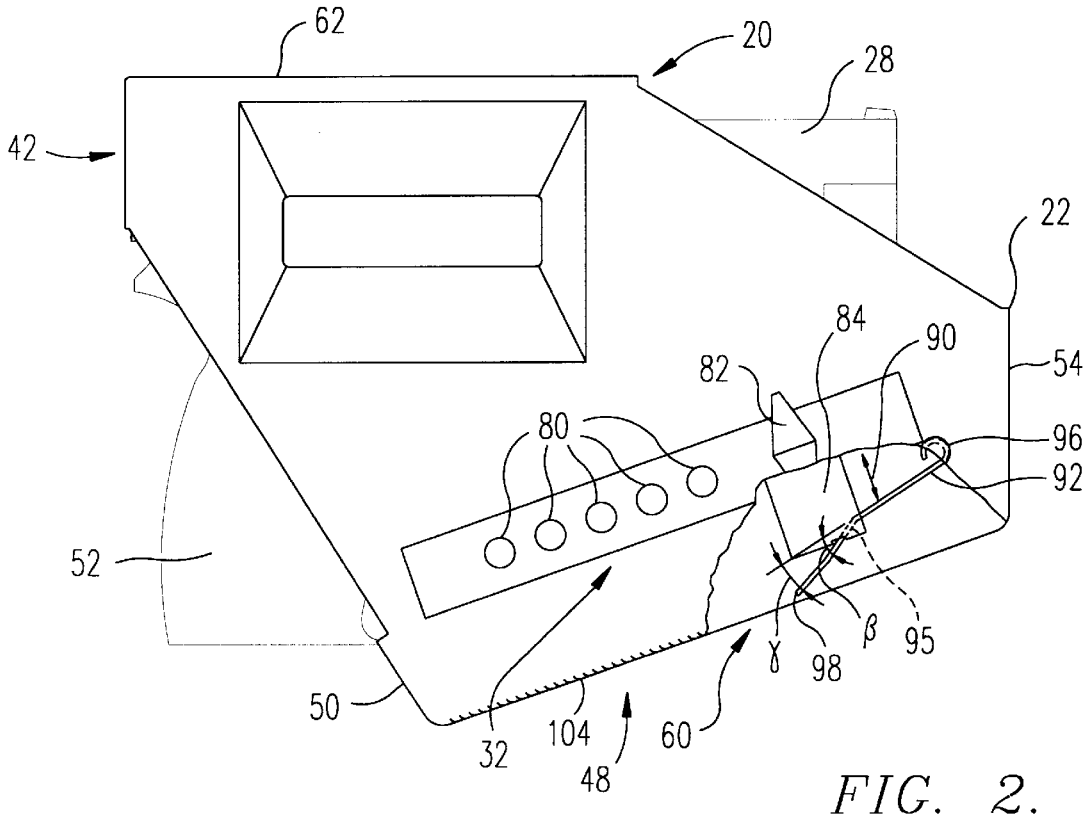
FIG. 2 is a front elevational view of the tamper-resistant safety gun lock of FIG. 1 shown in a closed position.

Referring to FIGS. 1 and 2, the outer case 22 is preferably made of a rigid metal and is bifurcated into the opposing sidewalls 24, 26, that are rigid and generally flat. When the case is in the closed position, the sidewalls are parallel, have aligned first and second perimeters, and are spaced apart to define the internal cavity 30. A plurality of lateral walls including a lateral hammer wall 42, lateral lock wall 48 and lateral breech wall 62 extend from the first sidewall 24 to the second sidewall 26 at an angle $\alpha$ of substantially 90°. The lateral hammer wall 42 is positioned adjacent to the hammer 38 of the firearm 28 to inhibit access to the hammer. The lateral hammer wall 42 is preferably constant from the first sidewall to the second sidewall and is comprised of a first hammer flange 44 extending from the first sidewall and a second hammer flange 46 extending from the second sidewall. Preferably, the first hammer flange 44 overlaps the second hammer flange 46.

The lateral lock wall 48 inhibits access to the lock mechanism 32. The lateral lock wall 48 has a handle end wall 50 adjacent to a handle 52 of the firearm and a muzzle end wall 54 adjacent to a muzzle 56 of the firearm 28. The handle and nozzle end walls inhibit access to the lock mechanism from the ends of the case. Each of the muzzle end wall 54 and the handle end wall 50 are made up of first flanges and second flanges extending from the first and second sidewalls respectively. The longest portion of the lateral lock wall comprises the catch wall 58 which extends from the handle end wall 50 to the muzzle end wall 54. The catch wall 58 inhibits access to the lock mechanism from the bottom of the case. The catch wall 58 of the lateral lock wall 48 also provides catch structure, generally designated 60, of the lock mechanism which will be described in detail later.

The lateral breech block wall 62 is positioned adjacent to both the breech 40 of the firearm and the lateral hammer wall 42, and both the lateral breech wall 62 and the lateral hammer wall are opposite the lateral lock wall 48 with the hammer wall extending from the breech wall at approximately 90°. Thus, the lateral breech wall 62 inhibits access to the breech of the firearm. The lateral breech wall is made up of a single flange extending from the first sidewall at an angle of approximately 90°. The hinge 25 forms a hinged connection between the lateral breech wall and the second sidewall allowing the case to move freely between the open and closed positions when the lock mechanism is disengaged. The second sidewall is provided with mounting holes 35. Thus, when the device is mounted to a surface, the hinge is adjacent to the mounting surface making it more difficult for an unauthorized person to gain access to the firearm by dismantling the hinge 25.

Figure 3:
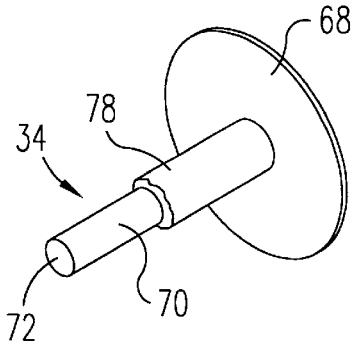
FIG. 3 is a fragmentary perspective view of a gun anchor according to the present invention.
Figure 4:
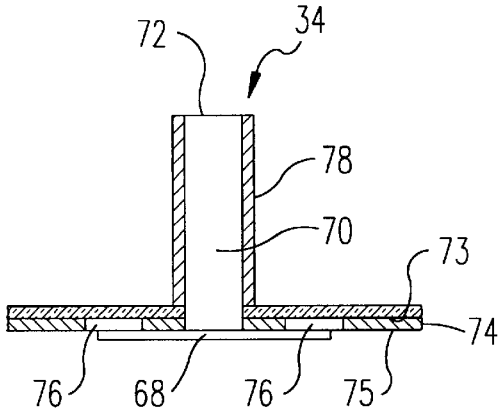
FIG. 4 is a fragmentary partial cross-sectional view of a gun anchor according to the present invention after it is positioned in the tamper resistant safety gun lock of FIG. 1.

Referring to FIGS. 3 and 4, as previously described the gun anchor preferably comprises a plurality of posts 34A, B, C extending through the internal cavity 30 from the first sidewall to the second sidewall to hold the firearm in place when the case 22 is closed. Each post 34 preferably comprises a flat circular disk 68 at one end thereof, an elongated middle section 70, and a tip 72 opposite the flat disk. The posts are preferably cylindrical with approximately ¼ inch diameters. The gun anchor cooperates with the sidewalls and the lateral walls which are arranged to hold the firearm in place and inhibit access to at least the trigger, hammer, and breech thereof In the preferred embodiment shown three posts are provided. A first post 34A is positioned adjacent a handle 52 of the firearm; a second post 34B is positioned within a trigger guard 66, and a third post 34C is positioned adjacent to and outside of the trigger guard 66. This configuration substantially imobilizes the firearm relative to the case. Thus, the posts in combination with at least the lateral walls form a gun anchor which holds the gun in position relative to the sidewalls when the case 20 is in the closed position.

Figure 5:
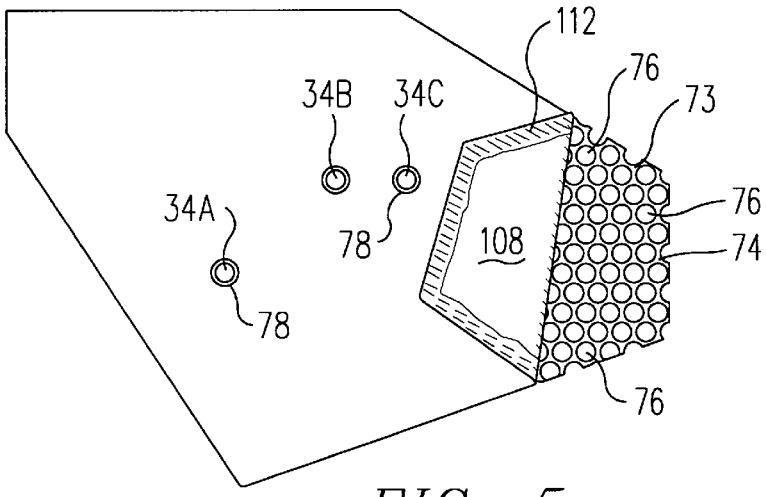
FIG. 5 is a top elevational view of a perforated plate for receiving the gun anchor of FIG. 3.
Figure 6:
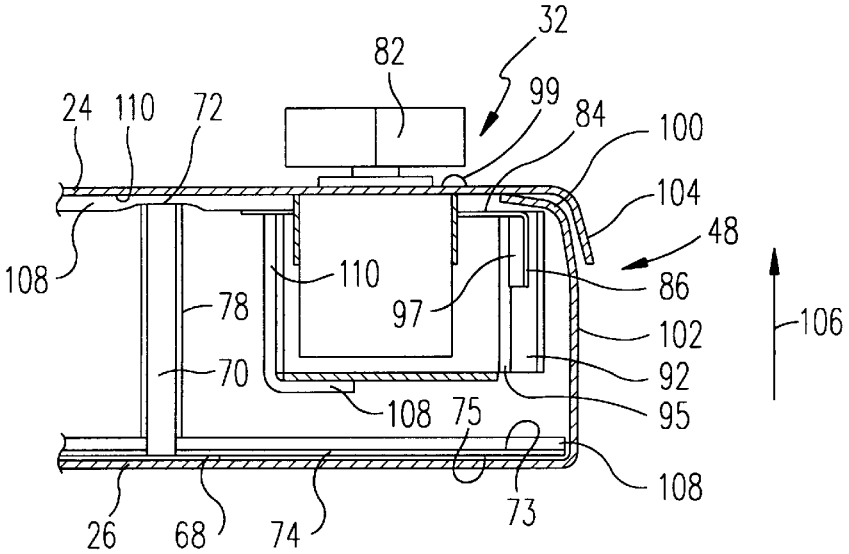
FIG. 6 is a fragmentary partial cross-sectional view of a lock mechanism according to the present invention.
Figure 7:
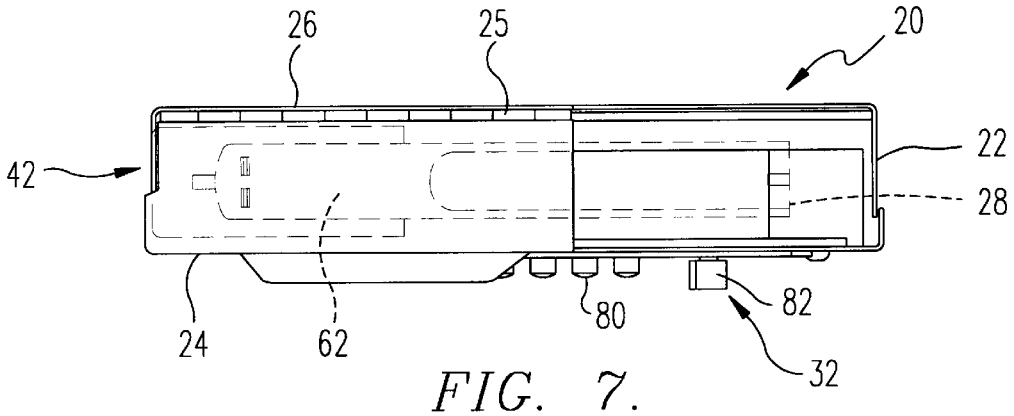
FIG. 7 is a top elevational view of the tamper-resistant safety gun lock of FIG. 1 in the closed position.
Figure 8:
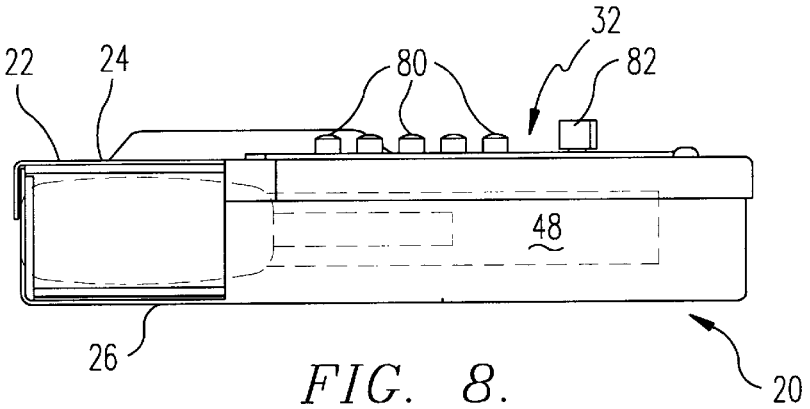
FIG. 8 is a bottom elevational view of the tamper-resistant safety gun lock of FIG. 1 in the closed position.
Figure 9:
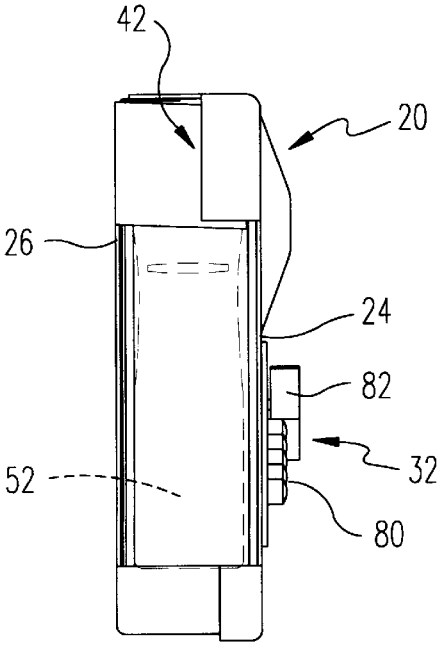
FIG. 9 is a handle end elevational view of the tamper-resistant safety gun lock of FIG. 1 in the closed position.
Figure 10:
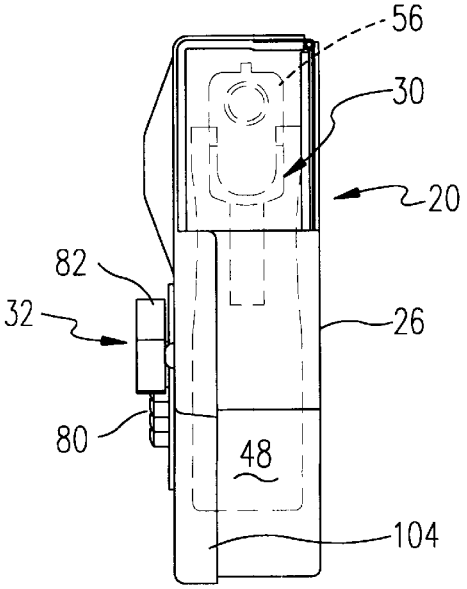
FIG. 10 is a muzzle end elevational view of the tamper-resistant safety gun lock of FIG. 1 in the closed position.

Referring additionally to FIGS. 5 and 6, each flat disk 68 is positioned adjacent to one of the sidewalls, and the tip 72 is adjacent to the other sidewall. The posts are held in a perforated plate 74 which has a plurality of single position gun anchor receptacles 76 extending through the plate 74 for receiving the posts. The receptacles are single position in that they have substan the same configuration as the posts, so that the posts have only one position in each receptacle. Further, the posts and receptacles in combination are self locating. That is, once a post is in a receptacle, the post is held in the desired location without further action from an operator. The anchor receptacles are preferrably circular with approximately ¼ inch diameters to receive the cylindrical posts. The perforated plate is held inside the case and has an internal side 73 facing the internal cavity and an outer side 75 facing an inner side one of the sidewalls. The perforated plate also has a plate perimeter which is aligned with the first and second perimeters of the first and second sidewalls. While each tip 72 and middle section 70 are sized to slidably extend through the receptacles 76 without impingement, the flat disk 68 is sized so that it will not pass through the receptacles. Thus, the flat disk is held between and abuts against the outer side 75 of the perforated plate 74 and the inner side of the adjacent sidewall. In the preferred embodiment shown the flat disk is adjacent to and inside the second sidewall 26 and the tip 72 is adjacent to and inside the first sidewall 24.

An anchor stop 78 preferably slides around the circumference of each post 34 to prevent the post from sliding out of its gun anchor receptacle 76. The gun anchor receptacles 76 are formed throughout the entirety of the area of the perforated plate 74 and are closely spaced, so that the posts are selectively positionable on the perforated plate and thus in the internal cavity. This allows a user to position the posts as needed for different firearms. Further, additional posts can be provided for different firearms. To assure that the posts may be placed where needed, the gun anchor receptacles 76 are spaced apart by approximately 1/16 inch. This spacing has been found to provide sufficient structural strength in the perforated plate while allowing the posts to be positioned as needed for a large variety of firearms.

Referring to FIGS. 1, 2, and 6, the lock mechanism 32 which locks the case 20 in the closed position preferably utilizes a combination lock having a locking assembly for locking and an unlocking assembly for unlocking the lock mechanism. The conventional components and operations of the disclosed combination lock will be discussed only to the extent necessary for a full understanding of the invention. The locking and unlocking assemblies preferably comprise a set of push buttons 80, a rotatable knob 82, and a lock piston 84. The case is unlocked by pushing the buttons 80 in the appropriate sequence and rotating the knob to retract the piston 84, and the case is locked by rotating the knob to extend the piston 84. The piston includes an inner leg 86 and an outer leg 88 which extend downwardly at approximately 90° from the direction of travel, indicated by arrow 90, of the piston.

A rigid latch plate 92 is pivotally mounted on a pivot pin 94 at a pivot end 96 of the plate 92. The plate 92 extends between the inner 86 and outer 88 legs of the piston. Where the latch plate 92 is held between the inner and outer legs, it has an intermediate bend 95 which begins with a bend angle $\beta$ of approximately 15° and ends at a bend angle $\gamma$ of approximately 8°. The inner leg is provided with a tab 97 which is angled away from the inner leg, so that the tab 97 is approximately parallel to the intermediate bend. The head 99 of the pivot pin 94 is exposed outside of the case, but the latch plate is positioned so that even if the pin is removed, the piston and the latch plate will not allow the case to be opened.

The piston 84 operates to extend a free end 98 of the latch plate 92 into a locked position (FIG. 2) and retract the free end 98 to a retracted position. When the latch plate is in the locked position, the latch plate extends beneath a catch 100 of the catch structure 60. The catch 100 protrodes inwardly from a catch component 102 of the lateral lock wall 48 toward the internal cavity 30 of the case 22. The catch component 102 extends from the second sidewall to form the catch wall portion 58 of the lateral lock wall 48. When the case is in the closed position, the catch extends approximately parallel to the sidewalls. Further, the catch has a length approximately equal to the catch wall 58, so that the latch plate cannot extend beyond the edges of the catch.

To make the case difficult to pry open, a cover 104 extends from the first sidewall 24 to cover the catch 100 and complete the lateral lock wall 48. Before someone could successfully pry the case 22 open, they would have to bend the cover 104 and the edge of the first sidewall 24 up to gain access to the catch 100, and then they would have to pry the catch upwardly. Further, as the catch 100 is pried upwardly, such prying motion forces the latch plate 92 into further engagement with the catch. In this configuration, the width W of the latch plate (FIG. 1), is substantially parallel to an opening direction 106 of the case and to the catch. With the width of the latch plate aligned parallel to the catch, the latch plate provides substantial strength in the direction that it would be loaded were someone to try and pry the case open. Thus, the configuration of the present invention is substantially more difficult to pry open than prior art arrangements.

To protect the firearm from damage while it is held in the case, an inner protective padding 108 is adhered to the internal surface 110 and the internal side 73 of the perforated plate 74 with an adhesive, such as tape 112. Additionally, the anchor stops 78 are preferably made of a non-abrasive and cushioning material such as rubber.

Although preferred forms of the invention have been described above, it is to be recognized that such disclosure is by way of illustration only, and should not be utilized in a limiting sense in interpreting the scope of the present invention. Modifications to the exemplary embodiments, as herein above set forth, could be readily made by those skilled in the art without departing from the spirit of the appended claims.

The inventor(s) hereby state their intent to rely on the Doctrine of Equivalents to determine and assess the reasonably fair scope of their invention as pertains to any apparatus or method not materially departing from but outside the literal scope of the invention as set out in the following claims.

We claim:

1. In a tamper-resistant safety gun lock, for securing a gun that has a trigger and a hammer from use, the improvement comprising:

a bifurcated outer case for inhibiting access to at least the trigger and the hammer of the gun, the case having a closed position, an open position for gun removal, a first sidewall, a second sidewall opposite the first sidewall, and a connection between the first sidewall and the second sidewall;

a lock mechanism operably disposed relative to the first sidewall and the second sidewall to lock the case in the closed position; and a self locating gun anchor selectively positionable entirely within the case to hold a gun in place relative to the first sidewall and the second sidewall when the case is in the closed position, the case inhibiting access to the gun anchor when the case is in the closed position.

2. In the gun lock according to claim 1, the gun anchor comprising a plurality of posts extending between the first sidewall and the second sidewall.

3. In the gun lock according to claim 1, the improvement further comprising at least one lateral wall extending from the first sidewall to the second sidewall, the gun anchor comprising the at least one lateral wall and a plurality of posts extending between the first sidewall and the second sidewall.

4. In the gun lock according to claim 1, the improvement further comprising a perforated plate having a plurality of gun anchor receptacles and being adjacent the first sidewall, the gun anchor comprising a plurality of posts extending through the gun anchor receptacles opposite the first sidewall, and a disk held between the perforated plate and the first sidewall whereby access to the gun anchor is inhibited by the case.

5. In the gun lock according to claim 1, the improvement further comprising a perforated plate having an outer side adjacent one of the first sidewall and the second sidewall and having a plurality of spaced apart gun anchor receptacles extending through the perforated plate and each gun anchor receptacle being configured to receive the gun anchor, so that the gun anchor is selectively positionable in the gun anchor receptacles.

6. In the gun lock according to claim 5, the gun anchor comprising three cylindrical posts, and the gun anchor receptacles comprising circular holes.

7. In the gun lock according to claim 5, the gun anchor comprising an elongated post extending through one of the gun anchor receptacles, a flat disk attached to the post and abutting against the outer side of the perforated plate and being sized not to pass through the gun anchor receptacles, and an anchor stop joined to the post and being sized not to pass through the gun anchor receptacles whereby the anchor is held in place relative to the perforated plate.

8. In the gun lock according to claim 7, the flat disk abutting against one of either a first sidewall inner side and a second sidewall inner side, the post comprising a tip opposite the flat disk, and the tip abutting against another of either the first sidewall inner side and the second sidewall inner side, and the anchor stop comprising a circumferential anchor stop fitting around the circumference of the post, and the disk comprising a circular disk.

9. In the gun lock according to claim 1, the improvement further comprising an internal protective padding adhered to an inner surface of the case, the connection comprising a hinged connection, and the case comprising an internal cavity for receiving the gun.

10. A tamper-resistant safety gun lock for securing a trigger and a hammer of a gun, the gun lock comprising:

a rigid case defining an internal cavity for receiving and holding the gun, the case having an open position, a closed position, a first sidewall, a second sidewall, and a plurality of lateral walls extending from the first sidewall to the second sidewall when the case is in the closed position, the lateral walls being positioned to enclose at least the trigger and hammer of the gun;

a lock mechanism housed in part inside the internal cavity for locking the case in the closed position; and a selectively positionable and self locating gun anchor extending through the internal cavity for holding the said gun in place and having a first end adjacent and inside the first sidewall and a second end adjacent and inside the second sidewall.

11. The gun lock according to claim 10 wherein the plurality of lateral walls comprises a lateral breech wall for inhibiting access to a gun breech, a lateral lock wall for inhibiting access to the lock mechanism, and a lateral hammer wall adjacent the lateral breech wall, and the lateral hammer wall being for inhibiting access to a gun hammer.

12. The gun lock according to claim 10 wherein the plurality of lateral walls comprises a lateral lock wall having an inwardly extending catch and a catch cover covering the catch whereby attempts to pry the locking mechanism are inhibited, and the lock mechanism comprises a latch plate extendable to engage the inwardly extending catch whereby the case is locked in the closed position.

13. The gun lock according to claim 10 further comprising a perforated plate having a plurality of gun anchor receptacles and wherein the gun anchor is slidably received in a selected one of the gun anchor receptacles.

14. A tamper-resistant safety gun lock for securing a gun, the gun lock comprising:

a rigid case defining an internal cavity for receiving and holding at least a portion of the gun, the case having an open position, a closed position, a first sidewall, and a second sidewall;

a lock mechanism housed in part inside the internal cavity for locking the case in the closed position;

a perforated plate adjacent to one of the sidewalls and having a plurality of spaced apart circular gun anchor receptacles therethrough; and a cylindrical gun anchor selectively positionable in and extending through at least one of the gun anchor receptacles and the internal cavity for holding the said gun in place and having a first end adjacent the first sidewall, and a second end adjacent the second sidewall.

15. The gun lock according to claim 14 wherein the first sidewall has a first perimeter, the second sidewall has a second perimeter, and the perforated plate has a plate perimeter aligned with at least one of the first and second perimeters.

16. The gun lock according to claim 14 wherein the perforated plate comprises an area, and the gun anchor receptacles are formed substantially entirely throughout the area of the perforated plate.

17. A tamper-resistant gun lock in combination with a gun having a trigger, a breech, a hammer, and a handle, the gunlock comprising:

a rigid case defining an internal cavity for receiving and holding the gun, the case having an open position, a closed position, a first sidewall, a second sidewall, and a plurality of lateral walls joining the first sidewall to the second sidewall;

a lock mechanism housed at least in part inside the internal cavity for locking the case in the closed position;

a selectively positionable gun anchor having an anchor configuration and extending through the internal cavity for holding the gun in place when the case is in the closed position and the gun anchor having a first end adjacent and inside the first sidewall and a second end adjacent and inside the second sidewall;

the sidewalls and lateral walls being arranged, when the case is in the closed position, to inhibit access to at least the trigger and the hammer of the gun; and a gun anchor receptacle having a receptacle configuration substantially the same as the anchor configuration and receiving the gun anchor therein.

18. The combination according to claim 17 wherein, when the case is in the closed position, the sidewalls have aligned perimeters, are spaced apart, and are substantially parallel; and the plurality of lateral walls extend at substantially 90° to the sidewalls, are aligned with the perimeters of the sidewalls, and comprise a lateral hammer wall, a lateral breech wall adjacent the lateral hammer wall, and a lateral lock wall generally opposite the lateral hammer wall and the lateral breech wall.

19. The combination according to claim 17 wherein the sidewalls and lateral walls are arranged, when the case is in the closed position, to inhibit access to the trigger, the breech, and the hammer of the gun.

20. The combination according to claim 17 wherein the anchor configuration is cylindrical and the receptacle configuration is circular.

21. A lock mechanism in combination with a tamper-resistant safety gun lock case including first and second sidewalls, an internal cavity defined between the sidewalls, a closed position, an open position, an opening direction, and a lateral lock wall extending from the first sidewall to the second sidewall the lock mechanism comprising:

a rigid catch extending from the lateral lock wall toward the internal cavity;

a latch plate retractably joined to the locking mechanism and being extendable from a retracted position to engage the catch in a locked position whereby the case is locked in the closed position;

a cover extending over the catch and forming a portion of the lateral lock wall;

a locking assembly for locking the locking mechanism, the locking assembly being operably coupled to the latch plate to extend the latch plate from the retracted position to the locked position; and an unlocking assembly for unlocking the locking mechanism, the unlocking assembly being operable coupled to the latch plate to retract the latch plate to the retracted position.

22. The combination according to claim 21 wherein the latch plate comprises a width substantially parallel to the opening direction of the case, and the locking and unlocking assemblies comprises a combination lock.

23. The combination according to claim 21 further comprising a piston operably coupled with the locking and unlocking assemblies and coupled with the latch plate for moving the latch plate in and out of the retracted and locked positions, and wherein the latch plate comprises a pivoting latch plate having a pivot end, a free end, and an intermediate bend between the pivot end and the free end.

24. The combination according to claim 23 wherein the piston comprises an outer leg and an inner leg, and the latch plate extends between the outer leg and the inner leg.

25. The combination according to claim 21 wherein the catch comprises an elongated catch extending substantially parallel to the sidewalls and having a length substantially equal to a catch wall portion of the lateral lock wall.

26. In a tamper-resistant safety gun lock, for securing a gun that has a trigger and a hammer from use, the improvement comprising:

a bifurcated outer case for inhibiting access to at least the trigger and the hammer of the gun, the case having a closed position, an open position for gun removal, a first sidewall, a second sidewall opposite the first sidewall, and a connection between the first sidewall and the second sidewall;

a lock mechanism operably disposed relative to the first sidewall and the second sidewall to lock the case in the closed position;

a gun anchor selectively positionable within the case to hold the said gun in place relative to the first sidewall and the second sidewall when the case is in the closed position, the case inhibiting access to the gun anchor when the case is in the closed position; and a perforated plate having a plurality of single position gun anchor receptacles and being adjacent the first sidewall, the gun anchor comprising a plurality of posts extending through the gun anchor receptacles opposite the first sidewall, and a disk held between the perforated plate and the first sidewall whereby access to the gun anchor is inhibited by the case.

27. The gun lock according to claim 26 wherein the gun anchor receptacles are circular and the gun anchors are cylindrical.

28. In a tamper-resistant safety gun lock, for securing a gun that has a trigger and a hammer from use, the improvement comprising:

a bifurcated outer case for inhibiting access to at least the trigger and the hammer of the gun, the case having a closed position, an open position for gun removal, a first sidewall, a second sidewall opposite the first sidewall, and a connection between the first sidewall and the second sidewall;

a lock mechanism operably disposed relative to the first sidewall and the second sidewall to lock the case in the closed position;

a self locating gun anchor selectively positionable entirely within the case to hold a gun in place relative to the first sidewall and the second sidewall when the case is in the closed position, the case inhibiting access to the gun anchor when the case is in the closed position;

a perforated plate having an outer side adjacent one of the first sidewall and the second sidewall and having a plurality of spaced apart gun anchor receptacles extending through the perforated plate and each gun anchor receptacle being configured to receive the gun anchor, so that the gun anchor is selectively positionable in the gun anchor receptacles;

the gun anchor comprising an elongated post extending through one of the gun anchor receptacles, a flat disk attached to the post and abutting against the outer side of the perforated plate and being sized not to pass through the gun anchor receptacles, and an anchor stop joined to the post and being sized not to pass through the gun anchor receptacles whereby the anchor is held in place relative to the perforated plate; and the flat disk abutting against one of either a first sidewall inner side and a second sidewall inner side, the post comprising a tip opposite the flat disk, and the tip abutting against another of either the first sidewall inner side and the second sidewall inner side, and the anchor stop comprising a circumferential anchor stop fitting around the circumference of the post, and the disk comprising a circular disk.

* * * * *